US007878353B2

(12) United States Patent
Casale et al.

(10) Patent No.: US 7,878,353 B2
(45) Date of Patent: Feb. 1, 2011

(54) OPENING DEVICE FOR A SEALED PACKAGE CONTAINING A POURABLE FOOD PRODUCT

(75) Inventors: Cristiano Casale, Spilamberto (IT); Elisa Michelini, Modena (IT)

(73) Assignee: Tetra Laval Holdings & Finance SA, Pully (CH)

( * ) Notice: Subject to any disclaimer, the term of this patent is extended or adjusted under 35 U.S.C. 154(b) by 939 days.

(21) Appl. No.: 11/658,401

(22) PCT Filed: Aug. 10, 2005

(86) PCT No.: PCT/EP2005/053947

§ 371 (c)(1),
(2), (4) Date: Jan. 26, 2007

(87) PCT Pub. No.: WO2006/018417

PCT Pub. Date: Feb. 23, 2006

(65) Prior Publication Data

US 2009/0039084 A1 Feb. 12, 2009

(30) Foreign Application Priority Data

Aug. 20, 2004 (EP) ..... 04104029

(51) Int. Cl.
*B65D 39/00* (2006.01)
*B65D 17/42* (2006.01)

(52) U.S. Cl. ..... 215/297; 220/277

(58) Field of Classification Search ..... 215/346, 215/341, 200, 297, 298, 254, 213, 217, 214, 215/218, 221, 295; 220/258.5, 258.3, 258.1, 220/260, 258.4, 255.1, 255, 266, 265, 277, 220/FOR. 206; 229/249, 248, 247; D9/437, D9/450, 449; *B65D 51/22, 41/20, 41/50, B65D 47/36*

See application file for complete search history.

(56) References Cited

U.S. PATENT DOCUMENTS 3,160,309 A * 12/1964 Rivas ..... 220/253

(Continued)

FOREIGN PATENT DOCUMENTS

DE 38 08 303 A1 9/1989

(Continued)

OTHER PUBLICATIONS

*International Search Report dated Nov. 2, 2005 issued by the European Patent Office acting as the International Searching Authority in International Application No. PCT/EP2005/053947; 3 pgs.

(Continued)

*Primary Examiner*—Anthony Stashick
*Assistant Examiner*—Robert J Hicks
(74) *Attorney, Agent, or Firm*—Buchanan, Ingersoll & Rooney PC

(57) ABSTRACT

An opening device for a sealed package containing a pourable food product and having at least one removable portion includes a frame defining a pour opening and having a fastening portion fixable to the package about the removable portion. A cap is adapted to be fitted to the frame to close the pour opening and is removable from the pour opening to permit pour-out of the food product. An anchoring portion which engages the pour opening is fixable directly to the removable portion, and is removable from the pour opening to at least partly detach the removable portion from the package. The anchoring portion is connected integrally to the frame by a breakable connecting mechanism, and is connected to the cap so as to move together with the cap when removing the cap from the pour opening.

13 Claims, 4 Drawing Sheets

U.S. PATENT DOCUMENTS

| | | | | | |
|---|---|---|---|---|---|
| 3,245,564 | A | * | 4/1966 | Hirsch | 215/213 |
| 3,369,707 | A | * | 2/1968 | Porter et al. | 222/83 |
| 3,937,348 | A | * | 2/1976 | Guala | 215/252 |
| 4,483,464 | A | * | 11/1984 | Nomura | 222/83 |
| 4,930,683 | A | | 6/1990 | Färber | |
| 5,020,690 | A | * | 6/1991 | Kishikawa et al. | 222/83 |
| 5,125,886 | A | | 6/1992 | Dirksing | |
| 5,348,182 | A | | 9/1994 | Luch | |
| 5,366,114 | A | * | 11/1994 | Bernstein et al. | 222/83 |
| 5,716,471 | A | | 2/1998 | Pape | |
| 6,056,142 | A | * | 5/2000 | Elliott | 220/278 |
| 6,382,462 | B1 | | 5/2002 | Ostergaard-Nielsen et al. | |
| 6,402,019 | B1 | | 6/2002 | Casale | |
| 2002/0179605 | A1 | * | 12/2002 | Miani et al. | 220/277 |
| 2003/0102279 | A1 | * | 6/2003 | Michael et al. | 215/204 |
| 2004/0104245 | A1 | * | 6/2004 | Dubach | 222/83 |
| 2004/0149786 | A1 | * | 8/2004 | Dubach | 222/541.2 |
| 2006/0071000 | A1 | * | 4/2006 | Weist et al. | 220/278 |

FOREIGN PATENT DOCUMENTS

| | | | | |
|---|---|---|---|---|
| DE | 44 09 945 | A1 | | 9/1995 |
| EP | 0 331 798 | B1 | | 9/1989 |
| EP | 0 755 862 | B1 | | 1/1997 |
| EP | 0 980 330 | B1 | | 2/2000 |
| EP | 1 145 975 | B1 | | 2/2000 |
| EP | 1 081 054 | A1 | | 3/2001 |
| EP | 1 277 662 | B1 | | 1/2003 |
| EP | 1 352 840 | A1 | | 10/2003 |
| EP | 1 627 819 | A1 | | 2/2006 |
| GB | 2241230 | A | * | 8/1991 |
| WO | 98/14317 | A1 | | 4/1998 |
| WO | 00/07891 | A1 | | 2/2000 |

OTHER PUBLICATIONS

*Written Opinion of the International Searching Authority dated the same date as the above-identified International Search Report and issued by the European Patent Office as the International Searching Authority in International Application No. PCT/EP2005/053947; 5 pgs.

* cited by examiner

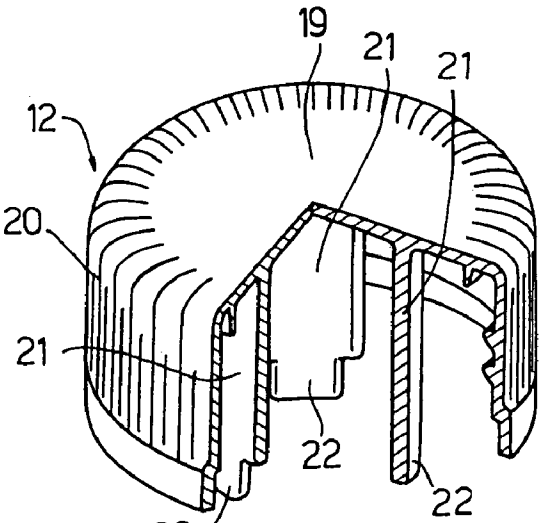
Fig.3
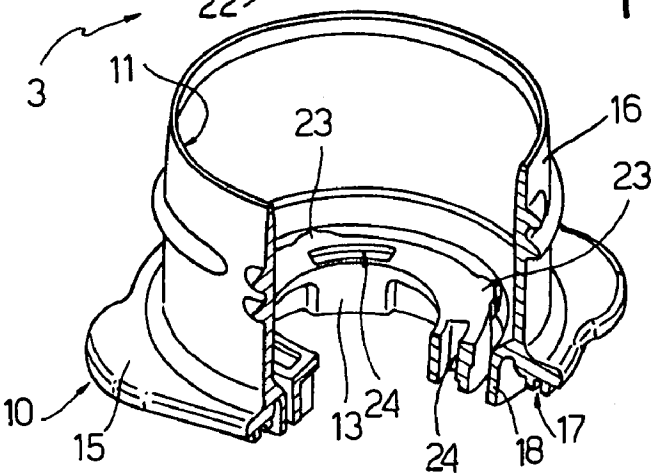
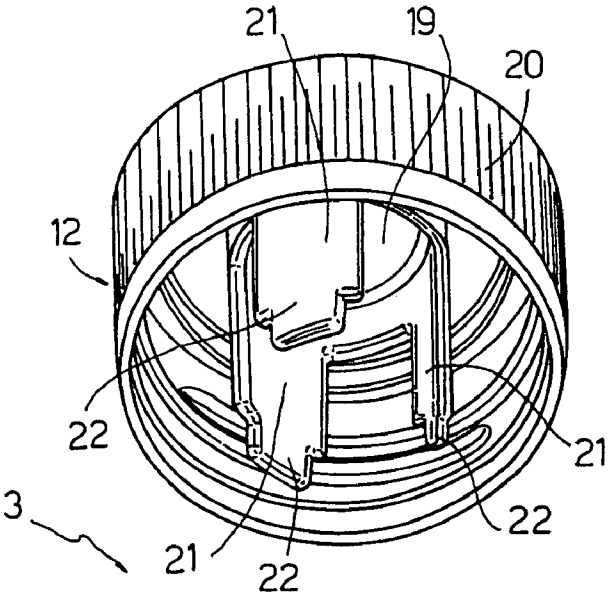
Fig. 2
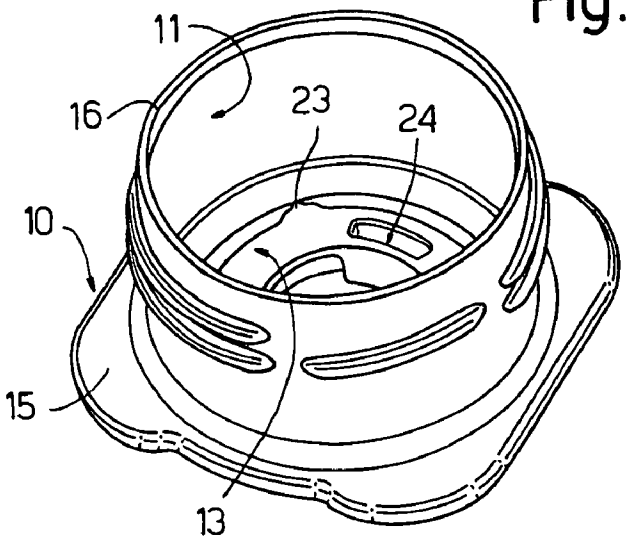

OPENING DEVICE FOR A SEALED PACKAGE CONTAINING A POURABLE FOOD PRODUCT

TECHNICAL FIELD

The present invention relates to an improved opening device for a sealed package containing a pourable food product.

BACKGROUND ART

As is known, many pourable food products, such as fruit juice, UHT (ultra-high-temperature treated) milk, wine, tomato sauce, etc., are sold in packages made of sterilized sheet packaging material.

A typical example of this type of package is the parallelepiped-shaped package for liquid or pourable food products known as Tetra Brik Aseptic (registered trademark), which is made by folding and sealing laminated strip packaging material. The packaging material has a multilayer structure comprising a base layer for stiffness and strength, which may comprise a layer of fibrous material, e.g. paper, or of mineral-filled polypropylene material, and which is covered on both sides with layers of thermoplastic material, e.g. polyethylene film. In the case of aseptic packages for long-storage products, such as UHT milk, the packaging material comprises a layer of oxygen-barrier material, e.g. aluminium foil, which is superimposed on a layer of thermoplastic material, and is in turn covered with another layer of thermoplastic material eventually forming the inner face of the package contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent such as a hydrogen peroxide solution, which is subsequently removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

The above packages are normally fitted with reclosable opening devices to protect the food product inside the package from contact with external agents, and to enable the product to be poured out.

At present, the most commonly marketed opening devices comprise a frame defining a pour opening for the food product, and fitted about a removable or pierceable portion of a top wall of the package; and a cap hinged or screwed to the frame, and which is removable to open the package. Alternatively, other types of opening, e.g. slide-open, devices are also known to be used.

The removable portion of the package may be defined, for example, by a so-called "prelaminated" hole, i.e. a hole formed in the base layer of the packaging material before covering the base layer with the layers of thermoplastic material and the layer of barrier material, which close the hole to ensure hermetic, aseptic sealing, while at the same time being easily pierceable.

Alternatively, the hole may be formed through the full thickness of the packaging material and covered with an additional so-called "patch" defined by a small sheet of thermoplastic material having a layer of oxygen-barrier material.

In one particularly advantageous solution described in the Applicant's Patent Application EP-A-1081054, the frame comprises an annular-flanged fastening portion fixed about the removable portion of the packaging material; and the cap has a cylindrical anchoring portion extending through the pour opening in the frame and fixed, preferably heat-sealed, directly to the removable portion covering the hole in the packaging material, so that, when removing the cap from the frame, the removable portion remains attached to the cap and is detached from the rest of the top wall of the package. In other words, to unseal the package, the user simply acts on the cap to detach the cap from the frame and detach the removable portion in one operation.

The above solution has since been improved further (as described in the Applicant's European Patent Application n. EP-A-1352840) by modifying the frame to form a further fastening portion having a tubular cylindrical liner extending about the anchoring portion of the cap, covering the edge of the hole in the packaging material, and fixed at one axial end to a peripheral edge of the removable portion.

The above alteration provides first and foremost for improving unsealing of the package and pour-out of the food product. That is, by virtue of the fastening portion with the cylindrical liner being fixed to the periphery of the removable portion, the anchoring portion of the cap is fixed to a better laminated, more radially inner portion of the removable portion, thus ensuring clean removal of the packaging material about the pour opening. Moreover, the fastening portion of the frame with the cylindrical liner defines a rigid contrast member, against which the material of the removable portion is torn, thus making the package easier to unseal, even when using particularly hard-to-tear thermoplastic materials, such as metallocene and LK25.

Once the removable portion is detached, the fastening portion with the cylindrical liner also prevents the hole from absorbing the food product, which, as is known, may occur when the package is left in a horizontal position for a relatively long period of time (eight hours on average), and which, particularly in the case of aggressive food products such as fruit juice, may result in detachment of the opening device.

Though advantageous and effective, the solutions described still leave room for further improvement, particularly as regards the precision with which the anchoring portion is fixed to the removable portion, and, hence, the precision with which the removable portion is detached from the package.

That is, given the inevitable tolerances between the cap and frame, the anchoring portion of the cap may not be centred perfectly with respect to the removable portion, thus resulting in less than perfect detachment of the removable portion when unsealing the package.

DISCLOSURE OF INVENTION

It is an object of the present invention to provide an opening device for a sealed package containing a pourable food product, designed to provide a straightforward, low-cost solution to the aforementioned drawback.

According to the present invention, there is provided an opening device for a sealed package containing a pourable food product, as defined in Claim 1.

BRIEF DESCRIPTION OF THE DRAWINGS

A preferred, non-limiting embodiment of the present invention will be described by way of example with reference to the accompanying drawings, in which:

FIG. 2 shows a larger-scale, exploded view in perspective of the FIG. 1 opening device;

FIG. 3 shows a larger-scale, partly sectioned, exploded view in perspective of the FIG. 1 opening device;

BEST MODE FOR CARRYING OUT THE INVENTION

Figure 1:
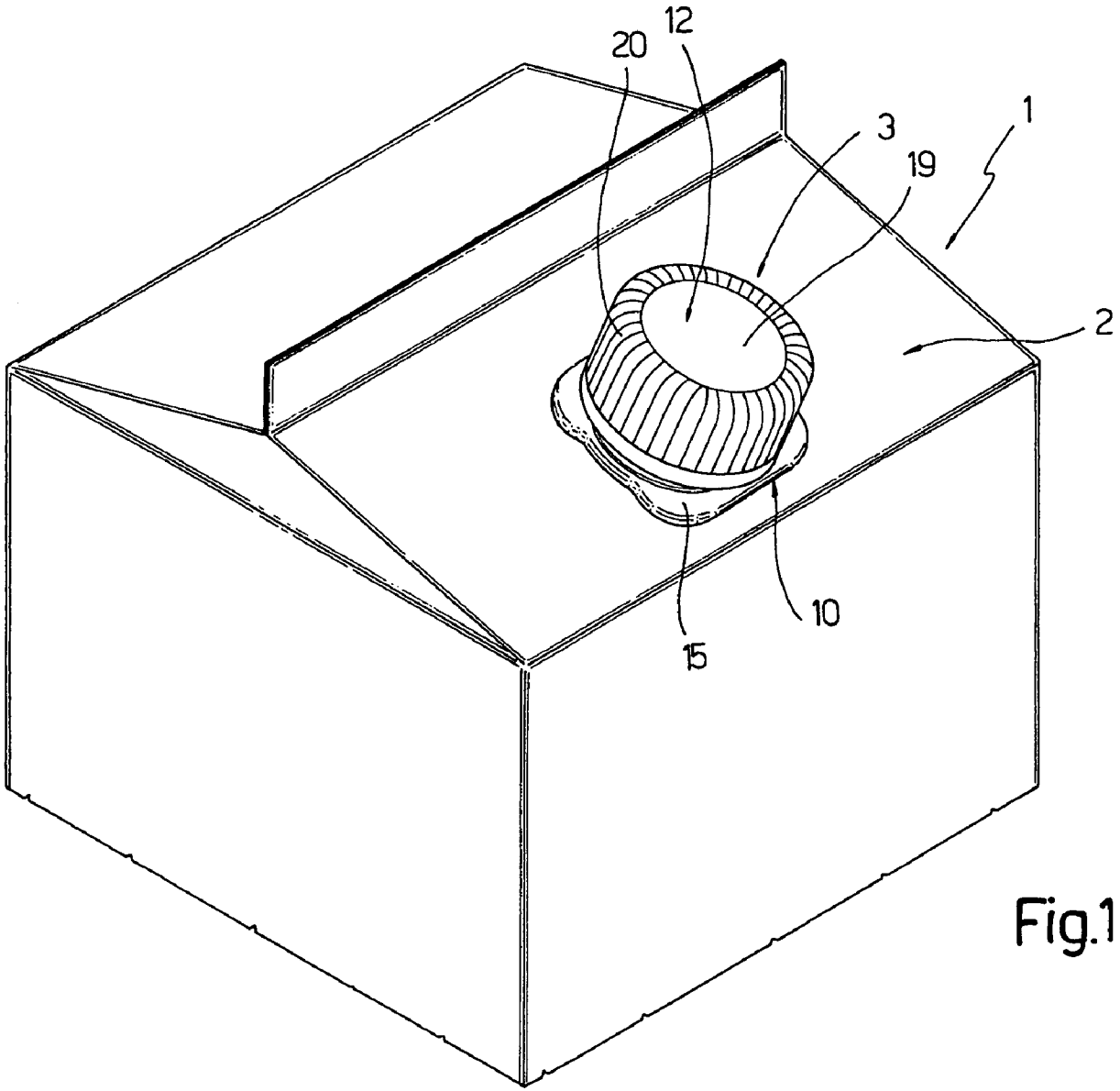
FIG. 1 shows a view in perspective of a top portion of a sealed package for pourable food products, having a reclosable opening device in accordance with the present invention.
Figure 5:
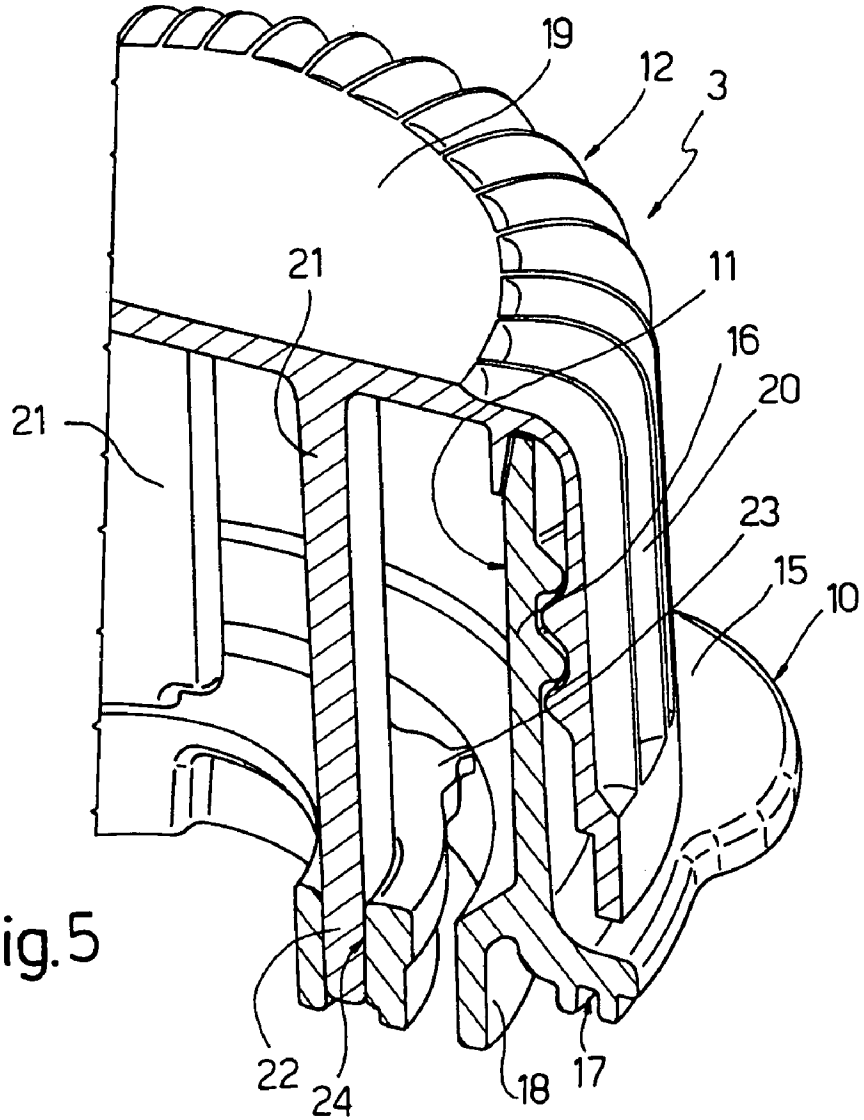
FIG. 5 shows an even larger-section, partly sectioned view in perspective of a detail of the FIG. 4 opening device.
Figure 4:
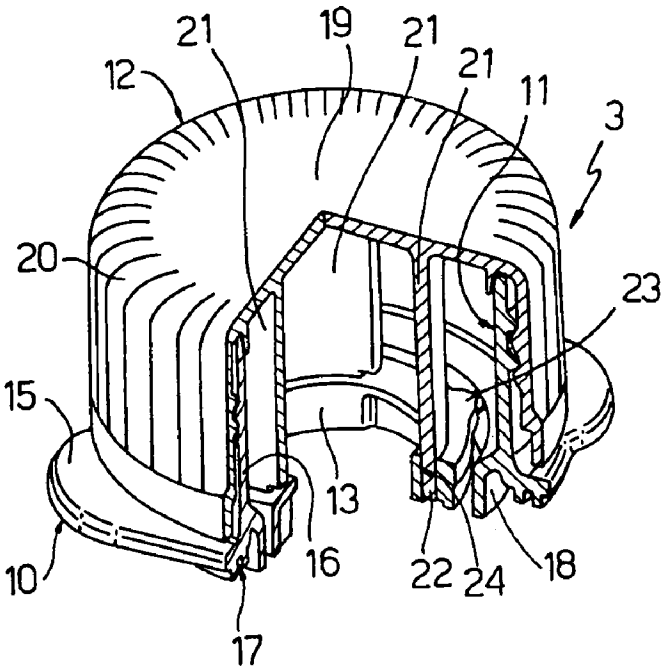
FIG. 4 shows a larger-scale, partly sectioned view in perspective of the FIG. 1 opening device in a closed configuration.

Number 1 in FIG. 1 indicates as a whole an aseptic sealed package for pourable food products, e.g. a parallelepiped-shaped package with a so-called "gable-top" top wall 2, commonly known by the trade name Tetra Rex (registered trademark), which is made from sheet packaging material as described in detail previously, and has a reclosable opening device 3 made of plastic material and applied to wall 2.

Figure 6:
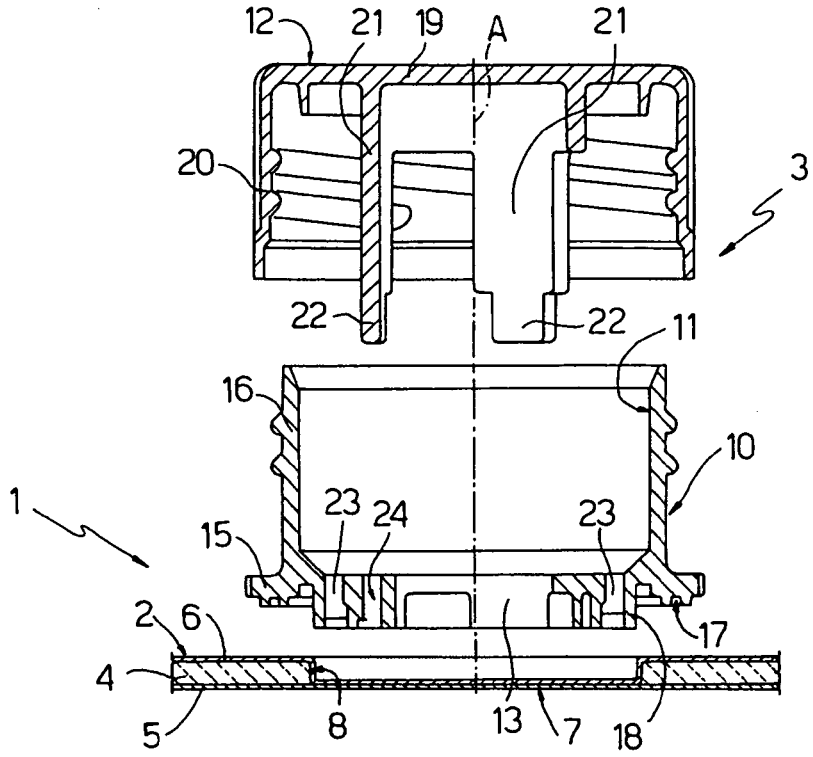
FIG. 6 shows an exploded axial section of the whole defined by the FIG. 1 opening device and the portion of the package to which it is eventually applied.
Figure 7:
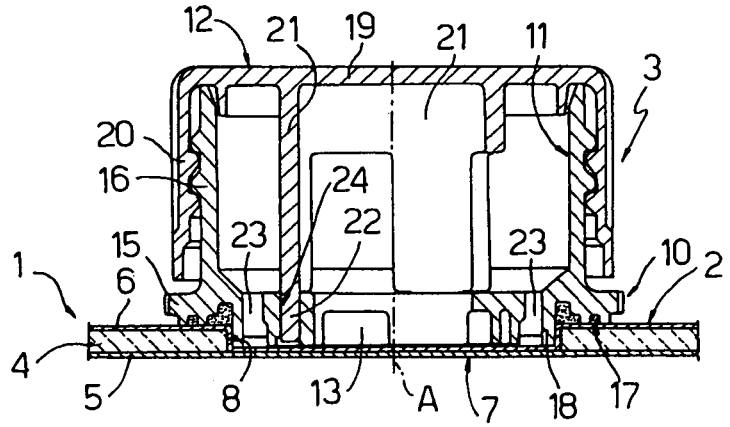
FIGS. 7 and 8 show axial sections similar to that in FIG. 6, and in which the opening device is applied to the relative package and shown in a sealed configuration and unsealed configuration respectively.
Figure 8:
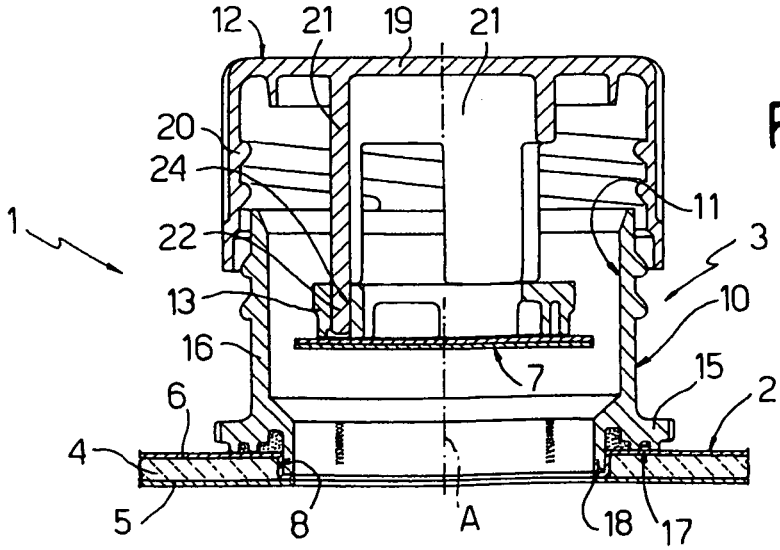

The packaging material of package 1 (FIGS. 6 to 8) has a multilayer structure, and comprises, in the example shown, a base layer 4 of fibrous material, e.g. paper or mineral-filled polypropylene, covered on opposite sides, respectively defining the inside and outside of package 1, with respective cover films 5, 6 including a number of layers of thermoplastic material, e.g. polyethylene, and at least one layer of oxygen-barrier material, e.g. aluminium.

Opening device 3 is applied to wall 2 of package 1 about a removable portion 7 of wall 2—in the example shown, a circular removable portion of axis A, i.e. a portion detachable from the rest of package 1 to enable the food product to be poured out.

Removable portion 7 is preferably formed by forming a hole 8, of axis A, through base layer 4 of the packaging material, and laminating layer 4 with cover films 5 and 6 to cover hole 8.

In an alternative solution not shown, removable portion 7 may be formed by forming a hole through the full thickness of the packaging material, and covering the hole with an additional "patch" defined by a small sheet of thermoplastic material having a layer of oxygen-barrier material.

With particular reference to FIGS. 2 to 8, opening device 3 comprises an externally threaded, annular frame 10 fixed to wall 2 of package 1 at removable portion 7 and defining a circular opening 11, of axis A, through which the food product is poured once hole 8 is opened; a cap 12 formed separately from frame 10 and screwed to frame 10 in a closed position closing opening 11 (FIGS. 4, 5, 7); and an anchoring member 13, of axis A, which engages opening 11, is fixed directly to removable portion 7, and is connected to cap 12. Package 1 is unsealed by unscrewing cap 12 with respect to frame 10 (FIG. 8), so that removable portion 7 remains attached, by means of anchoring member 13, to cap 12, and is detached from the rest of wall 2 of package 1, thus opening hole 8. Once unsealed, cap 12 is movable between said closed position and an open position (FIGS. 2, 3, 6) in which it is detached from frame 10.

More specifically, frame 10 substantially comprises an annular flange 15, of axis A, heat sealed or fixed by means of adhesive to wall 2 of package 1; and a cylindrical, internally threaded, annular portion 16, which projects perpendicularly and coaxially from the side of flange 15 opposite the side fixed to wall 2, and, together with flange 15, internally defines opening 11.

More specifically, along an annular surface 17 opposite the surface from which portion 16 extends, flange 15 is fixed about removable portion 7, and defines, from a radially inner edge, a cylindrical annular liner 18, of axis A, engaging hole 8 formed in base layer 4 of the packaging material, and fixed at the end to a peripheral portion of removable portion 7. That is, annular liner 18 projects coaxially from a radially inner edge of flange 15, in the opposite direction to annular portion 16, and combines with annular portion 16 to define pour opening 11.

Annular liner 18 thus covers the inner edge of hole 8 formed by removal of removable portion 7, to prevent said edge from absorbing the food product in the event the closed package 1 is left in a horizontal position.

Cap 12 comprises, integrally, a disk-shaped portion 19 for closing opening 11; and a cylindrical, internally threaded, annular portion 20 projecting from a circular outer peripheral edge of disk-shaped portion 19, and which screws onto annular portion 16 of frame 10.

Cap 12 also comprises, integrally, a number of tabs 21—in the example shown, three—which project perpendicularly inside annular portion 20 from disk-shaped portion 19, are equally spaced angularly about axis A, engage pour opening 11 of frame 10 in use, and are connected at their free ends 22 to anchoring member 13, as explained in more detail later on.

Advantageously, anchoring member 13 is formed integrally with frame 10, and is connected to frame 10 by a number of radial connecting bridges 23—in the example shown, three—which break off when cap 12 is unscrewed off frame 10.

More specifically, anchoring member 13 is ring-shaped, is located radially inwards of annular liner 18 of frame 10, and is connected integrally to liner 18 by breakable connecting bridges 23.

Anchoring member 13 also comprises three through openings 24, which have respective axes parallel to axis A, are equally spaced angularly, and are engaged, in use, by the free ends 22 of tabs 21 of cap 12.

Opening device 3 therefore substantially comprises two distinct parts: cap 12 and the integral assembly defined by frame 10 and anchoring member 13; which parts are injection molded separately, and are then fitted together and fixed to the packaging material of package 1.

More specifically, cap 12 is pressed onto annular portion 16 of frame 10, so that free ends 22 of tabs 21 engage respective openings 24 in anchoring member 13, with no mechanical connection of any sort.

Opening device 3 so formed is then fixed, e.g. hot-air sealed or by means of adhesive, to the packaging material, so that annular surface 17 of flange 15 adheres to the portion surrounding removable portion 7, and annular liner 18 and anchoring member 13 adhere respectively to the peripheral portion and a more radially inner portion of removable portion 7. During this operation, the free ends 22 of tabs 21 of cap 12 are made integral with anchoring member 13, by being joined to the edges of respective openings 24. In other words, anchoring member 13 is first formed in one piece with frame 10, and is later made integral with cap 12 and removable portion 7 when applying opening device 3 to the packaging material of package 1.

Package 1 is unsealed by rotating cap 12 with respect to frame 10 to unscrew it off frame 10. Cap 12 rotates integrally with anchoring member 13 to break off connecting bridges 23, remains attached to the portion of removable portion 7 joined to anchoring member 13, and so detaches said portion from the rest of wall 2 to open hole 8. More specifically, removable portion 7 is torn by shearing stress along the circular area interposed between anchoring member 13 and annular liner 18, and is removed completely from wall 2 of package 1. More specifically, annular liner 18 of frame 10 defines a rigid contrast member, against which the material of removable portion 7 is torn, thus making package 1 easier to unseal, even when using films 5 and 6 of particularly hard-to-tear, low-density thermoplastic material, such as metallocene and LK25.

The advantages of opening device 3 according to the present invention will be clear from the foregoing description.

In particular, because anchoring member 13 is formed integrally with frame 10 and only subsequently fitted to cap 12, the position in which anchoring member 13 is fixed to removable portion 7 is unaffected by the assembly tolerances of opening device 3. In fact, the distance between anchoring member 13 and annular liner 18 is fixed and independent of the thread engagement tolerances of cap 12 and frame 10. As a result, removable portion 7 is detached extremely accurately from wall 2 of package 1, thus making package 1 easier to unseal and improving pour-out of the food product.

Moreover, being formed in one piece, frame 10 and anchoring member 13 are made of the same material, so that, unlike known opening devices, in which both frame 10 and cap 12, normally made of plastic materials of different characteristics, must be fixed to the packaging material, opening device 3 can be sealed to wall 2 as best indicated by the characteristics of only one plastic material.

Moreover, because removable portion 7 is detached from the rest of wall 2 of package 1 at a better laminated portion radially inwards of the edge of hole 8, the packaging material inside pour opening 11 is removed neatly.

As will be clear from the detailed description of the way in which package 1 is unsealed, each component part of opening device 3 performs an active function: cap 12 activates anchoring member 13 of frame 10, which in turn removes removable portion 7.

Finally, unlike the solutions described in Patent Applications EP-A-1081054 and EP-A-1352840, the presence on cap 12 of a number of tabs 21 sealed to anchoring member 13, as opposed to a cylindrical portion fixed at the end directly to removable portion 7, provides for reducing the amount of raw material required to make cap 12, thus reducing cost, and for dissipating, as opposed to capturing, the fumes generated by heating opening device 3 to seal it to the packaging material.

Clearly, changes may be made to opening device 3 as described and illustrated herein without, however, departing from the protective scope as defined in the accompanying Claims.

In particular, opening device 3 may differ from the one described herein, e.g. may comprise a cap hinged to or slidable with respect to the frame; and the opening device may be designed to only detach part of removable portion 7 from wall 2 of package 1.

The invention claimed is:

1. An opening device for a sealed package containing a pourable food product and having at least one removable portion, said opening device comprising:

a frame defining a pour opening and having a fastening portion fixable to said package about said removable portion;

a cap fitted to said frame and comprising a closing portion closing said pour opening, the cap being removable from the frame to separate the closing portion from the pour opening to permit pour-out of the food product;

the cap comprising at least two straight tabs extending from the closing portion and projecting through the pour opening, each of the at least two straight tabs possessing a free end opposite the closing portion; and an anchoring portion, which engages said pour opening, is fixable directly to said removable portion, and is removable from the pour opening to at least partly detach said removable portion from said package;

wherein said anchoring portion is connected integrally to said frame by breakable connecting means, and is connected to said cap by virtue of the free ends of the at least two straight tabs being connected to the anchoring portion so as to move together with the cap when removing the cap from said frame.

2. A device as claimed in claim 1, wherein said anchoring portion is formed in one piece with said frame and subsequently fitted to said cap.

3. A device as claimed in claim 1, wherein said frame comprises a further fastening portion extending about said anchoring portion and fixed to a peripheral portion of said removable portion.

4. A device as claimed in claim 3, wherein said further fastening portion of said frame is frame-shaped, and at least partly defines said pour opening; and said breakable connecting means comprise a number of connecting bridges extending between the outer periphery of said anchoring portion and the inner periphery of said further fastening portion.

5. A sealed package containing a pourable food product, having at least one removable portion, and having an opening device as claimed in claim 1 and applied at said removable portion.

6. A method of forming the opening device as claimed in claim 1, and of applying said opening device to a sheet packaging material having at least one removable portion, said method comprising the steps of:

forming a single body defined by said frame and said anchoring portion joined to each other by breakable connecting means;

forming said cap;

fitting said cap to said frame to close said pour opening, by fitting the cap to said anchoring portion to produce said opening device; and fixing the opening device so formed to said packaging material, so that said fastening portion of said frame adheres about said removable portion, and said anchoring portion adheres to said removable portion.

7. A method as claimed in claim 6, wherein, when fitting said cap to said frame, connection of the cap to said anchoring portion is purely mechanical; and said cap is made integral with said anchoring portion when fixing said opening device to said packaging material.

8. A device as claimed in claim 2, wherein said frame comprises a further fastening portion extending about said anchoring portion and fixed to a peripheral portion of said removable portion.

9. A sealed package containing a pourable food product, comprising:

a hole formed in the package with a cover extending across the hole to provide a removable portion;

a frame defining a pour opening and having a fastening portion fixed to the package at a position at least partially surrounding the removable portion;

a removable cap engaging the frame and comprising a closing portion closing the pour opening, the cap being removable from the frame to move the closing portion away from the pour opening to open the pour opening;

an anchoring portion engaging the pour opening and fixed directly to an outer surface of the removable portion;

the cap comprising a plurality of straight tabs each having one end fixed to the closing portion and an opposite end fixed to the anchoring portion, the straight tabs extending away from the closing portion and being positioned in the pour opening;

the anchoring portion being connected to the cap by way of the straight tabs so that initial rotation of the cap rotates the anchoring portion to cause the removable portion to be torn away from a surrounding portion of the package by shearing stress resulting from rotation of the anchoring portion;

the anchoring portion being connected integrally to the frame by at least one breakable connecting portion that breaks upon the initial rotation of the cap;

the anchoring portion being separable from the pour opening while remaining fixed to the removable portion when the cap is removed from the pour opening to at least partly detach the removable portion from the surrounding portion of the package to open the hole in the package.

10. A sealed package as claimed in claim 9, wherein the anchoring portion is integrally formed in one piece with the frame.

11. A sealed package as claimed in claim 9, wherein the fastening portion is a first fastening portion, the frame also comprising a second fastening portion extending about the anchoring portion, the hole in the package having an inner edge, the second fastening portion extending into the hole so that an outer periphery of a free end portion of the second fastening portion faces the inner edge of the hole and covers the inner edge of the hole.

12. A sealed package as claimed in claim 11, wherein the second fastening portion of the frame is frame-shaped and at least partly defines the pour opening, the breakable portions comprising a plurality of connecting bridges extending between an outer periphery of the anchoring portion and an inner periphery of the second fastening portion.

13. A sealed package as claimed in claim 9, wherein the anchoring portion comprises a plurality of openings, each of the tabs being positioned in one of the openings in the anchoring portion.

* * * * *